United States Patent [19]

Taylor

[11] 3,954,265

[45] May 4, 1976

[54] BALANCED GOLF CLUB

[76] Inventor: David L. Taylor, 380 W. Carmel Valley Road, Carmel Valley, Calif. 93924

[22] Filed: Oct. 10, 1974

[21] Appl. No.: 513,564

[52] U.S. Cl. ..... 273/80 C; 273/164; 273/167 G; 29/407

[51] Int. Cl.[2] ..... A63B 53/02

[58] Field of Search ..... 273/77 R, 80 C, 164, 273/167–175, 183 D, 193 R, 194 R; D34/5 GH, 5 GC

[56] References Cited

UNITED STATES PATENTS

| | | | |
|---|---|---|---|
| 1,516,786 | 11/1924 | Prentiss | 273/77 A |
| 1,703,199 | 2/1929 | McClure | 273/164 X |
| 2,146,048 | 2/1939 | Barnhart | 273/80 C |
| 2,478,468 | 8/1949 | Drake | 273/80 C X |
| 2,957,696 | 10/1960 | Warpotas | 273/164 |
| 3,066,936 | 12/1962 | Hyde | 273/80 C |
| 3,077,350 | 2/1963 | Koorland | 273/164 |
| 3,166,320 | 1/1965 | Onions | 273/80 C |
| 3,332,684 | 7/1967 | Solheim | 273/167 G X |
| 3,448,981 | 6/1969 | Anweiler | 273/167 G X |
| 3,497,220 | 2/1970 | Scott | 273/167 G X |
| 3,632,112 | 1/1972 | Jacobs | 273/164 X |
| 3,680,860 | 8/1972 | Elkins | 273/164 X |
| 3,841,641 | 10/1974 | Bennett | 273/164 |
| 3,888,484 | 6/1975 | Zitko | 273/167 G X |
| D185,684 | 7/1959 | Todd | D34/5 GH |
| D204,466 | 4/1966 | Sowers | 273/164 X |
| D218,108 | 7/1970 | Wegener | D34/5 GH |
| D221,446 | 8/1971 | Cook | 273/164 X |
| D235,152 | 5/1975 | Mills | D34/5 GH |
| R19,178 | 5/1934 | Spiker | 273/169 X |

FOREIGN PATENTS OR APPLICATIONS

| | | | |
|---|---|---|---|
| 20,914 | 11/1894 | United Kingdom | 273/167 G |
| 710,688 | 6/1965 | Canada | 273/80 C |
| 238,646 | 10/1960 | Australia | 273/167 F |
| 12,743 | 6/1901 | United Kingdom | 273/167 F |

OTHER PUBLICATIONS

"Golf Digest;" Dec. 1972; p. 96, the Blockhead putter.

"Golf Digest;" June 1971; p. 122.

*Primary Examiner*—Richard J. Apley

[57] ABSTRACT

A precision made putter including a shaft and head in which the shaft has a compound reverse curve above the point of attachment to the head and is so positioned that the putter head and shaft are balanced with the club face upward and parallel to the ground, dictating the proper position of the shaft curves in relation to the head, and where the putter head has alternate stripes all at right angles to the face of the head and where the foot is slightly rounded toward each side and toward the rear from the face.

4 Claims, 8 Drawing Figures

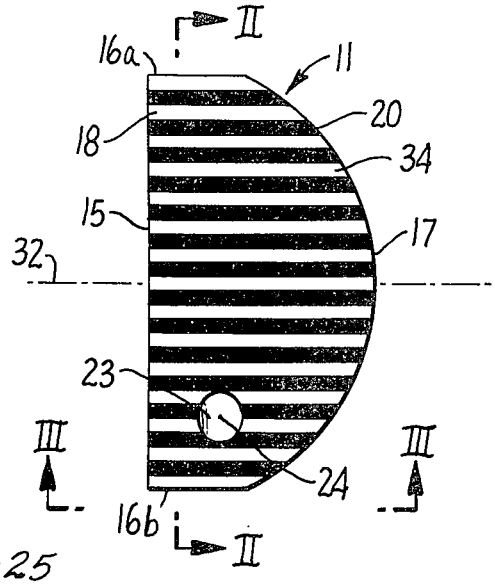
FIG. 1.
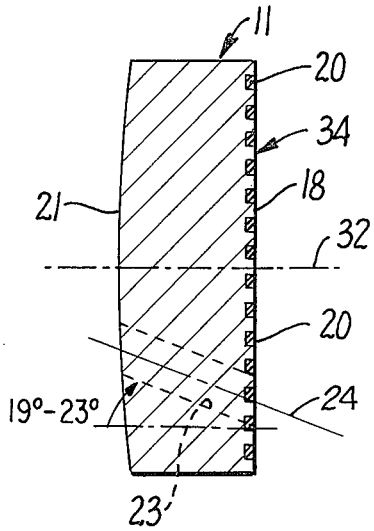
FIG. 2.
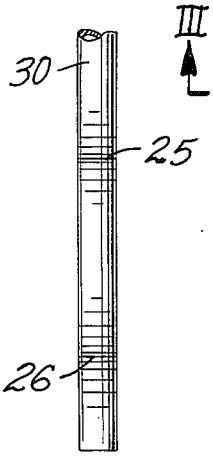
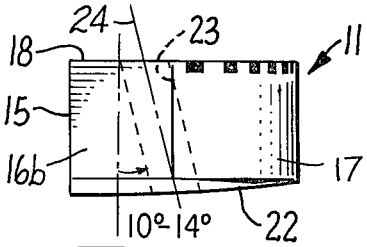
FIG. 3.
FIG. 7.
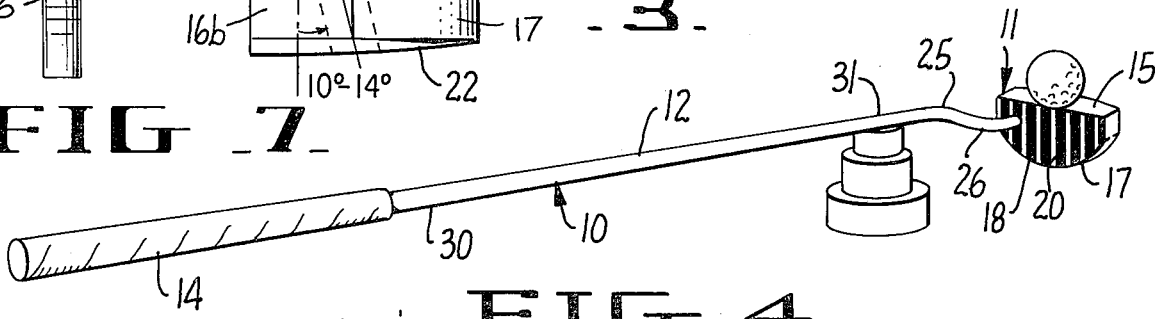
FIG. 4.
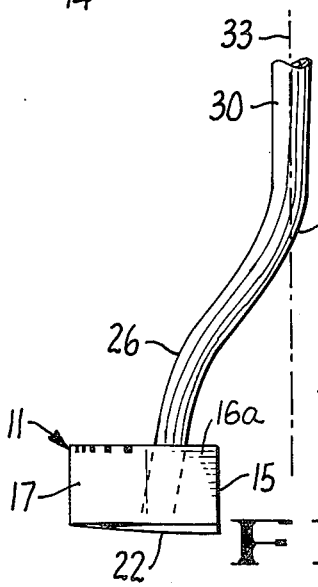
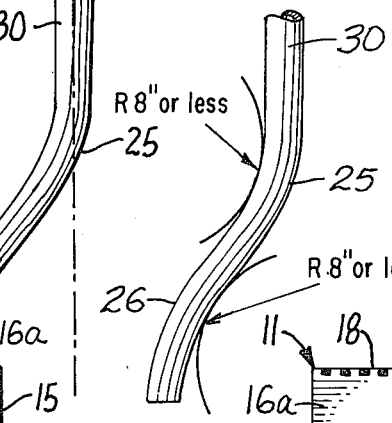
FIG. 8.
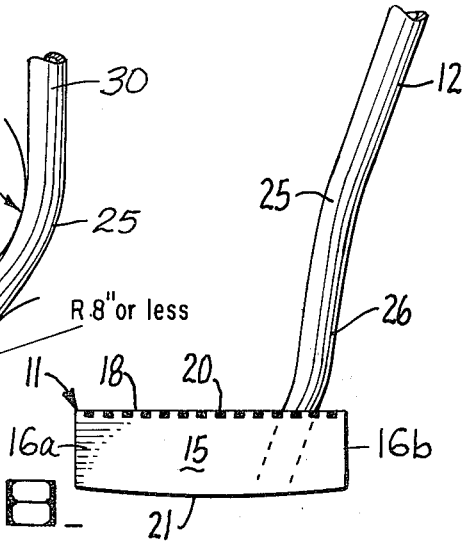
FIG. 5.
FIG. 6.

BALANCED GOLF CLUB

BACKGROUND OF THE INVENTION

The putter and the putting stroke using the putter in the game of golf have plagued all types of players from the professional to the beginner. Essentially, the hitting portion which is the face of the blade or other form of putter, must be placed square, i.e. at right angles to the target line of travel selected by the player. In other words, the face of the putter should be at right angles to the selected target line at the point of impact.

Once the putter head has been thusly positioned, the stroke and speed are mentally determined, and this requires concentration by the player. Numerous grips for making the stroke with the putter have been advocated over the years but, again, fundamentally in order to keep the putter head on the selected target line of travel the back of the left hand and the palm of the right hand should be square to the target line. The stroke with this grip appears to be the one which most consistently returns the face of the putter square to the line of travel at the point of impact.

The swing is a matter of mechanics. Many professionals advocate the arm and shoulder technique, and while this is used a great deal, it requires so many compensating movements that for the ordinary golfer it is too difficult to master or even to use correctly. The simplest and most effective stroke for the putt is the hinging or breaking action of the wrists. This allows the putter head to come naturally off of the ground in a proper arc on the back swing and returns the putter safely square to the line of target travel.

To assist this stroke, in addressing a putt the player should assume a relaxed position and be as comfortable as possible. To do this and still maintain the face of the putter on line with the target travel the hands should be held closely to the body and the club head toward the left foot, with the eyes of the player directly over the ball.

The object of all of this is to swing the putter face squarely back and through the ball on the selected line of the target travel.

The coordination of the mental processes and physical movements in the putting stroke has been a will-of-the-wisp amongst golfers since the start of the game. It has been a prolific source of suggestions, theories and gadgets, but few have made any real or substantial contribution to improve the pleasure and excellence of playing the game of golf on the green.

SUMMARY OF THE INVENTION

The putter shaft and the putter head disclosed herein are precision designed and made to cooperate and eliminate as much as possible, the mental do's and dont's which disturb the concentration of the player at the time of making the putting stroke.

One of the most fundamental contributions of the disclosure hereof is a putter head which does not require the lining up of a single line or marker on the top surface of the head, with the target line of travel. Numerous putters have a head which has a transverse line (short or extended) across the top surface whether it be a blade putter or a mallet type putter, to allegedly assist the player to line up the putter face with the selected line of target travel. Also, some putters provide a cross line or "T" adjacent the striking face, at a 90° angle to the transverse line, indicated on the top surface of the putter head. It has now been discovered quite unexpectedly that it is impossible for a player to select a proper line of target travel and line this up with a single transverse line on the putter head. The addition of a cross line at 90° thereto does not help much. Accordingly, to eliminate this problem the top surface of the putter head is provided with a plurality of spaced stripes over its entire area so that no matter where a player's eyes fall upon the top surface of the club head, the concentration for lining up is not limited to a single line or stripe. Since all of the stripes are uniformly transverse or at right angles to the face of the putter head, the concentration on a single line which is a false attribute, is eliminated and the alignment can be properly and quickly made and maintained.

Furthermore, the arrangement of the stipes on the club head unexpectedly produces sufficient time lag or memory in the human eye through movement, so that the human eye will retain a visual impression of the line of travel of the club head. This has been found most helpful in the production of a proper putting stroke, for a player can determine in each instance whether his stroke follows the target line of travel or not.

Additionally, the putter is balanced at a point adjacent to but spaced from the head of the club, so that the face of the putter is upward and parallel to the ground or support. This insures for the first time a proper test for establishing the location of the shaft in joining it to the putter head.

The shaft is also prepared with a compound reversed curve, all within the 4½ inch limitation between the sole of the putter and the straight portion of the shaft as required by P.G.A. and U.S.G.A. Rules. These curves are an essential part of the shaft as well as the mounting of the club head so that when the club is gripped naturally and comfortably the face of the putter head will be at right angles to the selected target line, and the stripes will visually indicate the line to the target or cup.

Further objects are to provide a construction of maximum simplicity, economy and ease of assembly and disassembly also such further objects, advantages and capabilities as will fully appear and as are inherently possessed by the device and invention described herein.

The invention further resides in the combination, construction and arrangement of parts illustrated in the accompanying drawings, and while there is shown therein a preferred embodiment thereof, it is to be understood that the same is illustrative of the invention and that the invention is capable of modification and change and comprehends other details of construction without departing from the spirit thereof or the scope of the appended claims.

BRIEF DESCRIPTION OF THE DRAWING

FIG. 1 is a top plan view of the head of the putter on an enlarged scale;

FIG. 2 is a longitudinal section taken on the line II—II of FIG. 1, looking in the direction of the arrows;

FIG. 3 is an end elevational view of the putter head taken on the line III—III of FIG. 1;

FIG. 4 is a perspective view of the entire putter showing the proper positioning of the shaft balanced so that the face is parallel to the ground;

FIG. 5 is a front elevational view of the lower portion of the putter aligned for the putting stroke, and with the axis of the lower most portion of the shaft lying in an axial plane which is angular with respect to the axial plane of the upper portion of the shaft;

FIG. 6 is a face elevational view of the lower portion of the putter.

FIG. 7 is an elevational view of the lower portion of the shaft with the reverse curves shown in the same axial plane.

FIG. 8 is an elevational view of the lower portion of the shaft taken at right angles to the axial plane of FIG. 7 and showing the radii of the reverse curves.

DESCRIPTION OF THE PREFERRED EMBODIMENTS

Referring now more particularly to the drawings in which like reference numerals indicate like parts in the several views, there is indicated generally at 10 the complete putter disclosed herein. The club is shown in its complete form in FIG. 4 and comprises in general a head 11, a shaft 12, and a grip 14.

The head 11 of the putter is very loosely classified as a mallet type head, having a substantially vertical face 15, although the face may be angled rearwardly from bottom to top to a maximum of 2° to give it a very slight loft. As shown in FIG. 1 at both sides there is a short flat areas 16*a* at the toe of the head and 16*b* at the heel which may be at right angles to the face 15, which curves rearwardly in a relatively flat arc 17 which is equal on both sides and meets continuously at imaginary line 32. This is only a suggested conventional shape for the head as any shape may be used following the principles set forth herein. Along the top surface 18 of the putter head 11 there are equally spaced stripes 20 which are at right angles to the face 15 of the head extending from the striking face rearwardly, the purposes of which will be explained hereinafter. The bottom or sole 21 of the head is on a uniform flat curve from top to bottom so that the mid point of the face as indicated by line 32 exhibits the highest altitude for the curve. The sole 21 is also curved from front to rear as shown at 22 in FIG. 3. This curve 22 is also relatively flat but extends from the face toward the rear with the curviture increasing slightly as it approaches the rear. This gives the sole 21 a rounded bottom with a compound curve, that is, it curves both longitudinally from top to bottom (as shown in FIG. 1.) and transversely from the face to the rear. (as shown in FIG. 3)

An offset hole 23 is bored in the head 11 with a calculated angularity. This angularity is in the range of 19° to 23°, but preferably 21°, downwardly upward toward the toe of the head and downwardly rearward of its center 24 in FIG. 1, as shown in the dotted lines of FIG. 2, and in the range of 10° to 14°, but preferably 12°, rearwardly with respect to the horizontal plane of the head as shown in dotted lines in FIG. 3. The angularity of this hole 23 is of importance in the balanced mounting alignment of the shaft 30. The U.S.G.A. "Rules of Golf" do not require the shaft to be attached at any particular location on the head. It is preferred for this putter to locate the shaft between the center line 32 and the heel, but especially adjacent the heel.

The shaft 30 is provided with a compound or reverse curve 25 and 26, as shown in FIGS. 5, 6 and 8. In bending the shaft 30 both curves 25 and 26 lie in the same plane, axially (see FIG. 7). In FIG. 5 the reverse curve is shown to bend laterally at 25 to form an offset position and at 26 to angularly enter the receiver hole 23, in the head, while the curve in FIG. 6 appears to turn forwardly at 26 and downwardly at 25.

The radius of the curves 25 and 26 at an 8 in. radius indicate that the balanced mounting of the shaft on the club head will bring the hands of the player on the grip of the club, well in front of a ball. Since some players prefer to have their hands directly over the ball the reverse curves 25 and 26 may be flattened. In any event regardless of the arc of the reverse curves, it is the balanced mounting alignment of the head 11 on the shaft 30, in the manner indicated which gives this putter some of its unique qualities and makes these qualities always the same. The plan shape of the head may vary and the position of the angular hole 23 in the head may be moved about, it is the angularity of the hole 23 and the reverse curves 25 and 26 of shaft 30 which make balanced mounting alignment possible. It cannot be accomplished in any other way.

These curves 25 and 26 are carefully calculated so that in the striking position shown in FIG. 5, when the shaft 30 is placed within the receiving hole 23 in the head, the line of the straight portion 12 of the shaft 30 will be in a plane parallel to the face 15 of the head 11. Because of these precise curves the shaft 30, when the shaft is mounted and received within the hole 23 and before permanent attachment, the head may be rotated thereon until the club balances at point 31 or area, with the face 15 of the head up-turned and parallel to the ground. It is to be noted that the balancing point or area 31 is adjacent the head but above the reverse curves 25 and 26. With these precise curves and the compound hole 23 angularly the balancing of the putter as shown in FIG. 4, makes it possible to secure the shaft in the club head 11 in a proper manner, and only in the proper manner. The face balancing therefore gives precision alignment and set between the shaft 30 and the club head 11. All of the curved portions of shaft 30, are within the 4½ in. limitation from the sole 21 to the beginning of the straight portion 30, of the shaft so as it complies with the Rules of the U.S.G.A. and the P.G.A.

It is apparent, therefore, that the reverse curves or gooseneck in the shaft 30 are not an essential part of the club in and of itself, but rather as it is twisted or rotated into the proper position for balanced alignment mounting, its relationship to the club head changes until the balanced alignment is achieved. It is therefore the means for securing balanced alignment mounting rather than merely a fixed gooseneck accomplishing little, if anything.

OPERATION

The use of the putter 10 eliminates many of the fundamental considerations which race through and confuse a player's mind as do's and dont's at the time of striking the ball in making the putt. The proper impact point for striking a golf ball is the center line 32 of the club head on the face 15 thereof. In addressing the ball the player sights down the straight portion 12 shaft 30 along the line 33 which is in a plane to the straight face 15 of the head 11. Upon the selection of the target line for the travel of the putt, the face 15 is lined up at right angles to the line of travel. Instead of looking and placing the club head with only one median line to aid in the alignment, i.e., along the line 32, if such is provided, the top surface 34 of the head is visible. The player is not dependent upon any single line, as the whole top 34 has stripes 20 which are at right angles to the face 15 of the putter head and extend rearwardly from the face 15. A player is not hypnotized by the concentration on a single line, or left without any guide, surprisingly the multiplicity of contrasting stripes 20 is a great and valid aid in alignment with the target line of travel.

In making the stroke the spaced stripes 20 produce a memory within the eye so that the movement indicates a continuous line through most of the stroke. It is very much like a stroboscopic effect and the persistence of the image in the human eye makes the line of the stroke visible briefly. Sub-consciously this guides the back stroke and the return stroke to the point of impact so that at the point of impact the face 15 is at right angles to the selected line of target travel.

In putting, not only is the target line important but also the putting stroke. In serious putting it is well to take a few practice strokes. With the present putter head 11, during the practice strokes the player can see exactly what the path of his stroke really is by concentrating on the lines 20. The pattern of "after vision" makes the line of the stroke visible. This visual stroke guide provides one of the most important aspects of putting. The proper movement of this stroke provides the player with a highly confident mental state with which to execute the putt. One cannot over emphasize the importance of the confidence of everything in its place and working as it should. The alignment of the putt becomes easier and the player is really ready to make the putt. As one concentrates on the ball in making the putt, the player is only conscious of the lines 20, which aids him enormously in bringing the face 15 squarely into contact with the ball.

The remarkable benefits of this putter and particularly the putter head can only be appreciated through actual experience. Experience which is the great teacher, demonstrates that the many advantages of this club, a unique combination of shaft and head, as well as others, are actually attained.

I claim:

1. A golf club used for the putting stroke having a shaft, a grip mounted at one end of said shaft and a head mounted at the other end provided with a striking face, a toe portion, a heel portion, and a rear portion, said shaft having reverse curves at the lower portion thereof adjacent the point of attachment in said head, said head having a receiving hole for permantly mounting said shaft angled downwardly upward toward the toe thereof and downwardly rearward away from the striking face of the head, said reverse curves lying in the same axial plane as the upper portion of said shaft and rearwardly thereof and with the axis of said lower portion being angularly disposed relative to said upper shaft portion, said same axial plane being rearwardly inclined relative to a vertical plane normal to the striking face of the club, said upper portion of said shaft being in a vertical plane in advance of and parallel to the plane of said striking face, whereby with said receiving hole being as angulated and said reversed curves being so positioned said club will be in its balanced mounting alignment such that said striking face will be upturned and parallel to the ground when said club is horizontally balanced at its balancing area adjacent to and above said reverse curves.

2. A putter of claim 1 wherein the reverse curves of said shaft are made of a radius of 8 inches or less.

3. A putter of claim 1 wherein the reverse curves of said shaft are made on a radius 8 inches or less and with said downwardly upward angle being from 19° to 23° and said downwardly rearward angle being from 10° to 14°.

4. A putter in claim 1, wherein the reverse curves of said shaft are made on a radius of 8 inches or less said downwardly upward angle being from 19° to 23° and said downwardly rearward angle being from 10° to 14°, and with the top surface of said head having a plurality of spaced parallel stripes, said stripes extending from said striking face in a rearwardly and normal disposition.

* * * * *